US005718122A

United States Patent [19]

Maeda

[11] Patent Number: 5,718,122

[45] Date of Patent: Feb. 17, 1998

[54] AIR CONDITIONING SYSTEM

[75] Inventor: Kensaku Maeda, Fujisawa, Japan

[73] Assignee: Ebara Corporation, Tokyo, Japan

[21] Appl. No.: 781,050

[22] Filed: Jan. 9, 1997

[30] Foreign Application Priority Data

| | | | |
|---|---|---|---|
| Jan. 12, 1996 | [JP] | Japan | 8-022135 |
| Jan. 12, 1996 | [JP] | Japan | 8-022136 |
| Jan. 12, 1996 | [JP] | Japan | 8-022137 |
| Jan. 12, 1996 | [JP] | Japan | 8-022138 |

[51] Int. Cl.[6] ..... F25B 21/00; F25D 23/00

[52] U.S. Cl. ..... 62/185; 62/238.3; 62/271

[58] Field of Search ..... 62/94, 271, 238, 62/3, 185

[56] References Cited

U.S. PATENT DOCUMENTS

| | | | |
|---|---|---|---|
| 2,700,537 | 1/1955 | Pennington | 261/83 |
| 4,430,864 | 2/1984 | Mathiprakasam | 62/94 |
| 4,887,438 | 12/1989 | Meckler | 62/271 |
| 5,325,676 | 7/1994 | Meckler | 62/93 |
| 5,448,895 | 9/1995 | Coellner et al. | 62/94 |

FOREIGN PATENT DOCUMENTS

| | | | |
|---|---|---|---|
| 62-297647 | 12/1987 | Japan . | |
| 404165240 | 6/1992 | Japan | 62/271 |

*Primary Examiner*—William E. Wayner

*Attorney, Agent, or Firm*—Armstrong, Westerman, Hattori, McLeland & Naughton

[57] ABSTRACT

An air conditioning system is provided by combining a first air conditioning device for processing mainly a sensible heat load, a second air conditioning device using desiccant for dehumidification of the air, and a heat pump as a heat source, so that not only the cooling tower is no longer necessary but a significantly higher coefficient of performance is possible.

11 Claims, 12 Drawing Sheets

AIR CONDITIONING SYSTEM

BACKGROUND OF THE INVENTION

1. Field of the Invention

The present invention relates in general to air conditioning systems, and relates in particular to an air conditioning system, aimed primary for use as a cooling system. The conditioning system utilizes a combined use of a desiccant assisted air conditioner operated by a heat pump for dehumidification and cooling with an air conditioner for processing sensible heat.

2. Description of the Related Art

FIG. 11 is an example of conventional air conditioning facilities for buildings using heat pump arrangements. Conventional air conditioning system of this type produce ambient air having appropriate temperature and humidity by a process of cooling and dehumidifying the air followed by reheating the air to lower its relative humidity. In this approach, a double bundle type heat pump was used as a heating source. An example is shown in FIG. 11, where the reference numeral 1 refers to a heat pump; 2 to a evaporator; 3 to a compressor; 4 to a hot water condenser (condenser); 5 to a cooling water condenser (condenser); 7 to an expansion valve; 10 to a cooling water pump; 11 to a hot water pump; 13 to a cooling water pump; 14 to a cooling tower; and these heat pump components are used to produce chilled water and hot water which are supplied to the chilled water passages (cooling medium passages) 20, 21 and the hot water passages (heating medium passage) 30, 31 provided within the building 60.

Inside the building, to process the heat load in the regions of the building, the chilled water passages 20, 21 are connected to a plurality of heat exchange devices 51A~51E such as fan coil unit units (hereinbelow referred to as fan coil unit units), for heat exchange with ambient air through corresponding passages 44A~44E and 45A~45E. In the core region of the building, the chilled water passages 20, 21 and the hot water passages 30, 31 are provided with a plurality of air handling units 50A~50E, respectively, through the passages 40A~40E, 41A~41E, 42A~42E and 43A~43E for the purpose of taking in outside air OA and return air RA, supplying processed air as supply air SA to the conditioning spaces 61A~61E, and removing exhaust air EX to outside environment, thereby conducting an air conditioning (cooling) of the building.

In this conventional arrangement of air conditioning, ambient air in the conditioning spaces 61A~61E is cooled by the chilled water within the air handling units 50A~50E so as to condense and remove moisture in the air, and is heated again (reheat process) by the hot water to adjust temperature and humidity to a suitable and comfort level. The ambient air circulated in the conditioning spaces 61A~61E is also cooled by fan coil unit units 51A~51E, primarily to lower the sensible heat generated by the solar radiation heat. The heat load generated by air conditioning processes within the building 60 is consumed in heating the chilled water and cooling the hot water, as a result of heat transfer of the air within the space. In the heat source, the chilled water of a raised temperature is cooled in the evaporator 2 and the heat pump pumps up heat in the hot water condenser 4 and the cooling water condenser 5, and a part of the pumped-up heat is used to heat the hot water, but the remainder of the heat is discarded in the cooling tower 14.

The flow of heat in the conventional type of air conditioning system is shown in FIG. 12. The heat extracted from the chilled water and the input power to the compressor driver are input into the heat pump, and a portion of the output heat is used to heat the hot water, and the remainder is discarded in the cooling tower. Taking the heat supplied by the compressor driver as 1 thermal unit and using a commonly quoted coefficient of performance (COP) which is 4 for usual heat pumps, the input heat by the chilled water is 4 thermal units. In the meantime, the output heat is of 1+4 to a total of 5 thermal units, and a portion of this output heat is used to reheat the hot water as is mentioned above. However, looking at the overall heat balance of the air conditioning for the building, this reheating process represents an input of thermal energy into the building, and should therefore be taken to be an internal load on the chilled water, which is circulated in the system. Therefore, the quantity of heat available purely for the cooling process is less than 4 thermal units, i.e. input heat from the chilled water passage. It follows that the value of actual COP in the conventional type of air conditioning system is given by:

$$\text{actual } COP = \text{actual Cooling Effect/compressor driver input} < 4/1 = 4$$

which indicates that actual COP for the system is less than 4.

The above conclusion shows that in the conventional systems, reheating process is an internal load to increase the heat load on the compressor driver, and the recovered heat from the chilled water is not utilized and is discarded in the cooling tower. Thus, it can be seen that, in air conditioning systems of typical conventional design, energy utilization is incomplete and actual COP has not been optimized.

SUMMARY OF THE INVENTION

It is an object of the present invention to provide a high performance air conditioning system, by eliminating reheating step so as to reduce air conditioning load, recovering all the output heat from the heat pump which has been discarded in the conventional air conditioning system and utilizing it as a regeneration heat source for desiccant, thus eliminating a cooling tower.

The object has been achieved in an air conditioning system comprising: a heat pump; a heating medium passage for circulating a heating medium for extracting a heating capacity from the heat pump; a cooling medium passage for circulating a cooling medium for extracting a cooling capacity from the heat pump; a first air conditioning device including a first heat exchanger for obtaining ambient control of conditioning spaces by heat exchange between the cooling medium in the cooling medium passage and air within a conditioning space; a second air conditioning device including a process air passage, a regeneration air passage and a desiccant device communicatable alternatingly with either the process air passage or the regeneration air passage for dehumidification of process air and regeneration of the desiccant device by regeneration air; and a regeneration heat exchange device for heating the regeneration air, by heat exchange between the regeneration air circulating in the regeneration air passage and the heating medium circulating in the heating medium passage.

In such a configuration of the air conditioning system, by combining, a first air conditioning device for processing mainly a sensible heat load, a second air conditioning device using desiccant for dehumidification of the air, and a heat pump as a heat source, not only the cooling tower for discarding waste heat is no longer necessary but a significantly higher coefficient of performance is possible.

It is preferable that the first air conditioning device be a sensible heat exchanger for providing internal circulation of process air, however, other air conditioning device such as a desiccant assisted air conditioning device based on Pennington cycle, for example, may also be used.

DESCRIPTION OF THE PREFERRED EMBODIMENTS

A first embodiment will be explained with reference to FIGS. 1 to 4.

Figure 1:
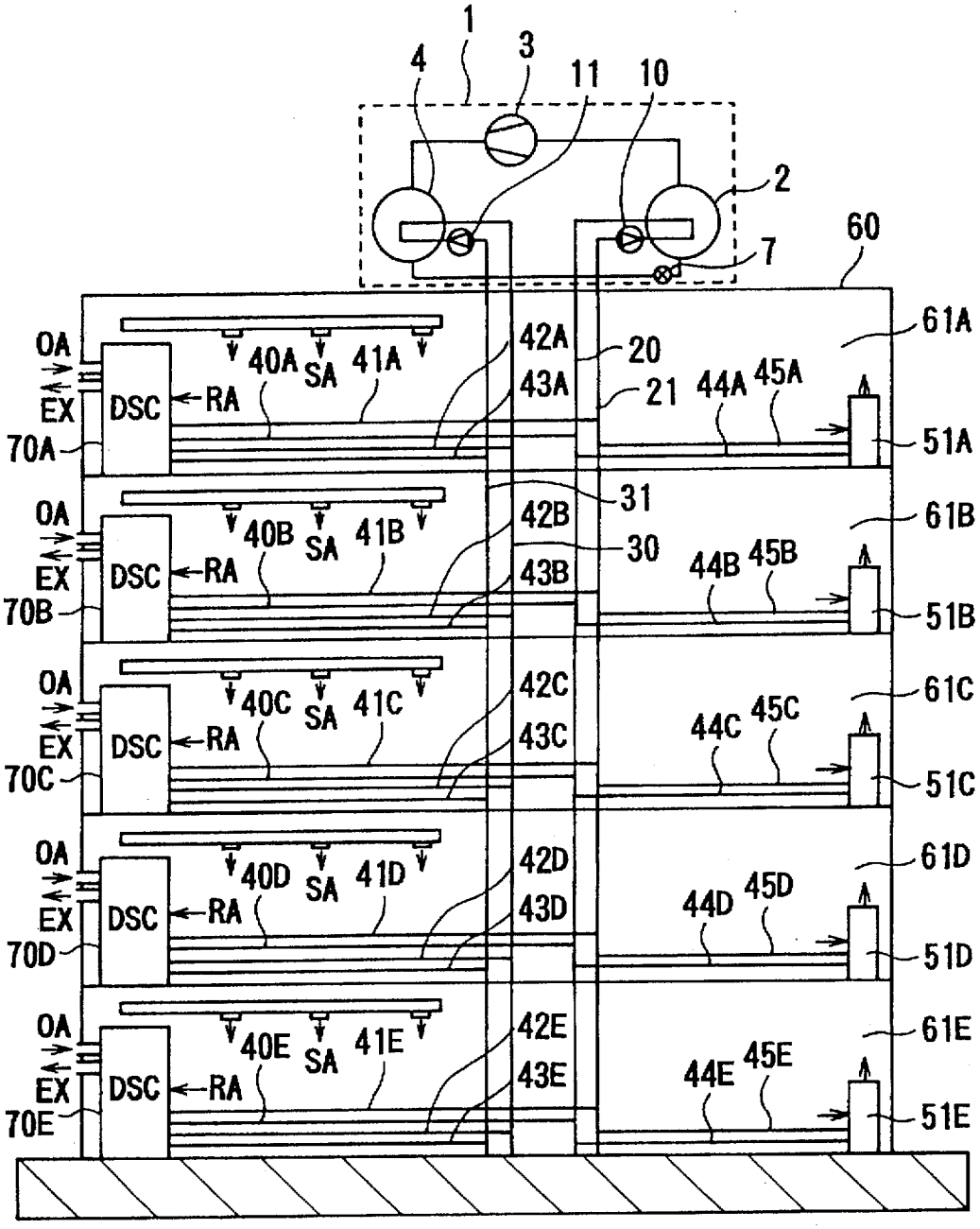
FIG. 1 is a schematic representation of the basic configuration of a first embodiment of the present air conditioning system.

FIG. 1 is a schematic representation of the basic configuration of the air conditioning system of the present invention, which combines a desiccant assisted air conditioner with another air conditioning device for removing sensible heat. In FIG. 1, the reference numeral 1 refers to a heat pump indicated by the dotted line; 2 to a evaporator; 3 to a compressor; 4 to a hot water condenser; 7 to an expansion valve 10 to a cooling water pump; and 11 to a hot water pump. This heat pump is utilized to produce chilled water and hot water to be supplied, respectively, to the chilled water passages (cooling medium passages) 20, 21 and the hot water passages (heating medium passages) 30, 31.

To process the sensible heat load in the perimeter regions of the building, a plurality of fan coil units 51A~51E are connected to the chilled water passages 20, 21 through the passages 44A~44E and 45A~45E, respectively. In the core (center) region of the building, a plurality of desiccant assisted air conditioners 70A~70E are connected to the chilled water passages 20, 21 and the hot water passages 30, 31 through the passages 40A~40E, 41A~41E, 42A~42E and 43A~43E for conditioning air. As explained below with reference to FIG. 2, the desiccant assisted air conditioners 70A~70E are arranged so as to conduct air conditioning by taking in outside air OA and return air RA, supplying processed air to the conditioning spaces 61A~61E through the ducts as supply air SA as well as exhausting spent air EX to outside environment.

In the air conditioning system of such a configuration, that portion of the cooling load for processing the latent heat to obtain dehumidification effect of ambient air is performed in the desiccant assisted air conditioners 70A~70E, and that part of the cooling load in the perimeter regions for removing the sensible heat resulting from sun shine is performed in the fan coil units 51A~51E. In the conventional systems, latent heat processing has also been provided by chilled water directly, and therefore, it was necessary to provide the chilled water cooled to a temperature below the dew point of the process air, thus necessitating the chilled water to be supplied generally at about 5°~7° C. However, in the present system, the chilled water is only required to perform sensible heat removing, and therefore, it is sufficient if the chilled water is about 10° C. lower than the temperature of ambient air so that the temperature of the chilled water circulating is about 15° C. For desiccant assisted air conditioning, it is necessary that the regeneration air be at 60°~80° C., and the temperature of the hot water circulated is at 70°~90° C.

Figure 2:
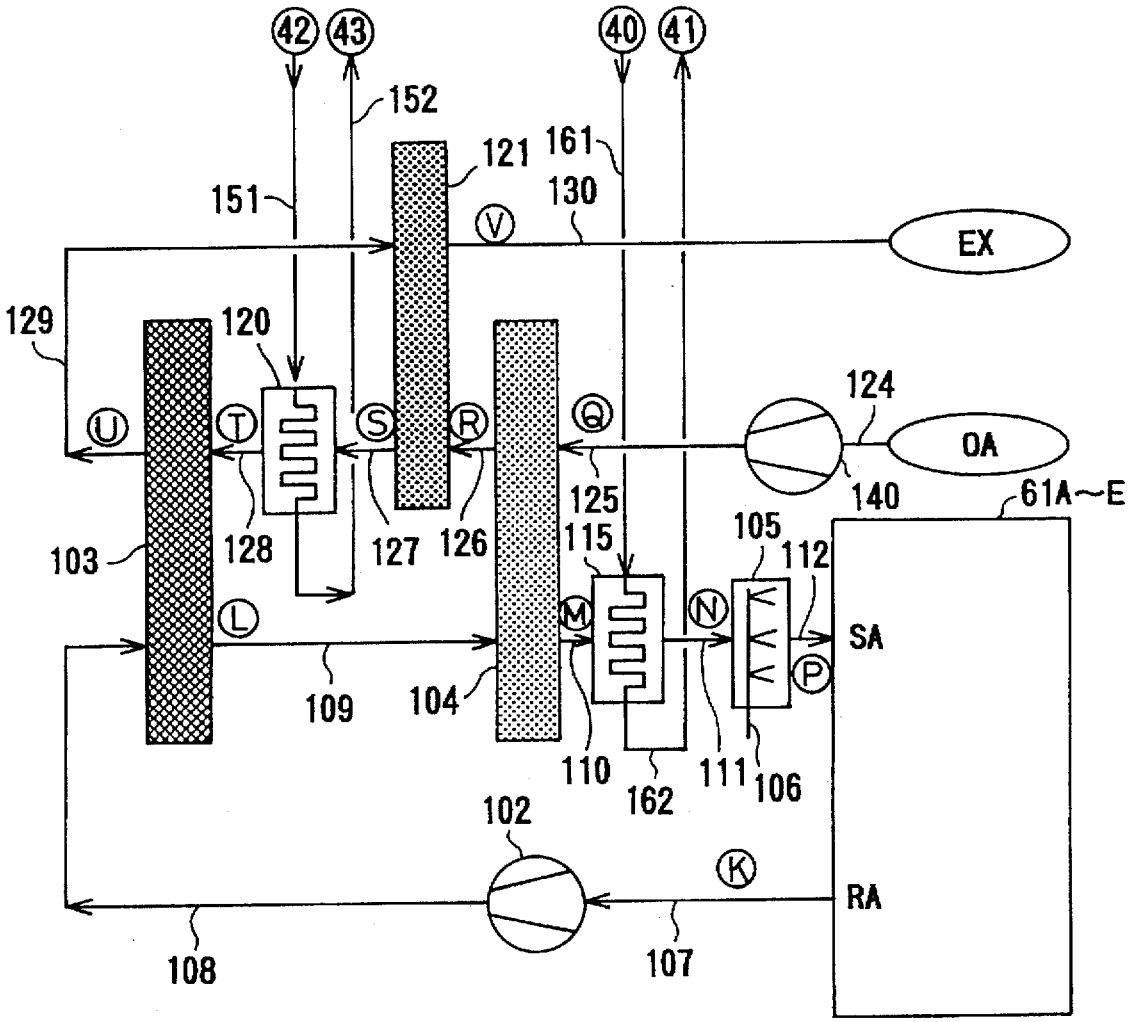
FIG. 2 is a schematic representation of the desiccant assisted air conditioner section in the first embodiment.

FIG. 2 is a schematic representation of the desiccant assisted air conditioner. The desiccant air conditioner shown in FIG. 2 is constructed as follows: the conditioning spaces 61A~61E is communicated with the intake of the blower 102 through the passage 107; the outlet of the blower 102 is communicated with the desiccant wheel 103 through the passage 108; the discharge for the process air from the desiccant wheel 103 is communicated with the sensible heat exchanger 104 heat-exchangeable with the regeneration air through the passage 109; the outlet for the process air from the heat exchanger 104 is communicated with the chilled water heat exchanger 115 through the passage 110; the outlet for the process air from the chilled water heat exchanger 115 is communicated with the humidifier 105 through the passage 119; and the outlet for the process air from the humidifier 105 is communicated with the conditioning spaces 61A~61E through the passage 111; thereby completing a processing cycle for the process air.

In the meanwhile, the processing route for the regeneration air is as follows: outside air is introduced by connecting the intake of the blower 140 through the passage 124; the outlet of the blower 140 is communicated with the sensible heat exchanger 104 heat-exchangeable with the process air through a passage 125; the outlet for the regeneration air from the sensible heat exchanger 104 is communicated with the inlet of the low temperature side of another heat exchanger 121 through a passage 126; the outlet of the low temperature side of the sensible heat exchanger 121 is communicated with the hot water heat exchanger 120 through the passage 127; the outlet for the regeneration air of the hot water heat exchanger 120 is communicated with the inlet of the regeneration air to the desiccant wheel 103 through the passage 128; the outlet for the regeneration air of the desiccant wheel 103 is connected to the inlet of the high temperature side of the sensible heat exchanger 121 through the passage 129; the outlet of the high temperature side of the sensible heat exchanger 121 is communicated with the external space through the passage 130 so that outside air can be introduced for use as regeneration air.

The hot water inlet of the hot water heat exchanger 120 is communicated with the hot water passage 30 of the heat pump through the passages 42A~42E. The hot water outlet of the hot water heat exchanger 120 is communicated with the hot water passage 31 of the heat pump through the passages 43A~43E. The chilled water inlet of the chilled water heat exchanger 115 is communicated with the chilled water passage 20 of the heat pump through the passages 40A~40E, and the chilled water outlet of the chilled water heat exchanger 115 is communicated with the chilled water passage 21 of the heat pump through the passages 41A~41E. In FIG. 2, the circled alphabetical designations K-V refer to the thermodynamic states of the air corresponding to those in FIG. 3, and SA designates supply air, RA designates return air, OA designates outside air and EX designates exhaust air.

Figure 3:
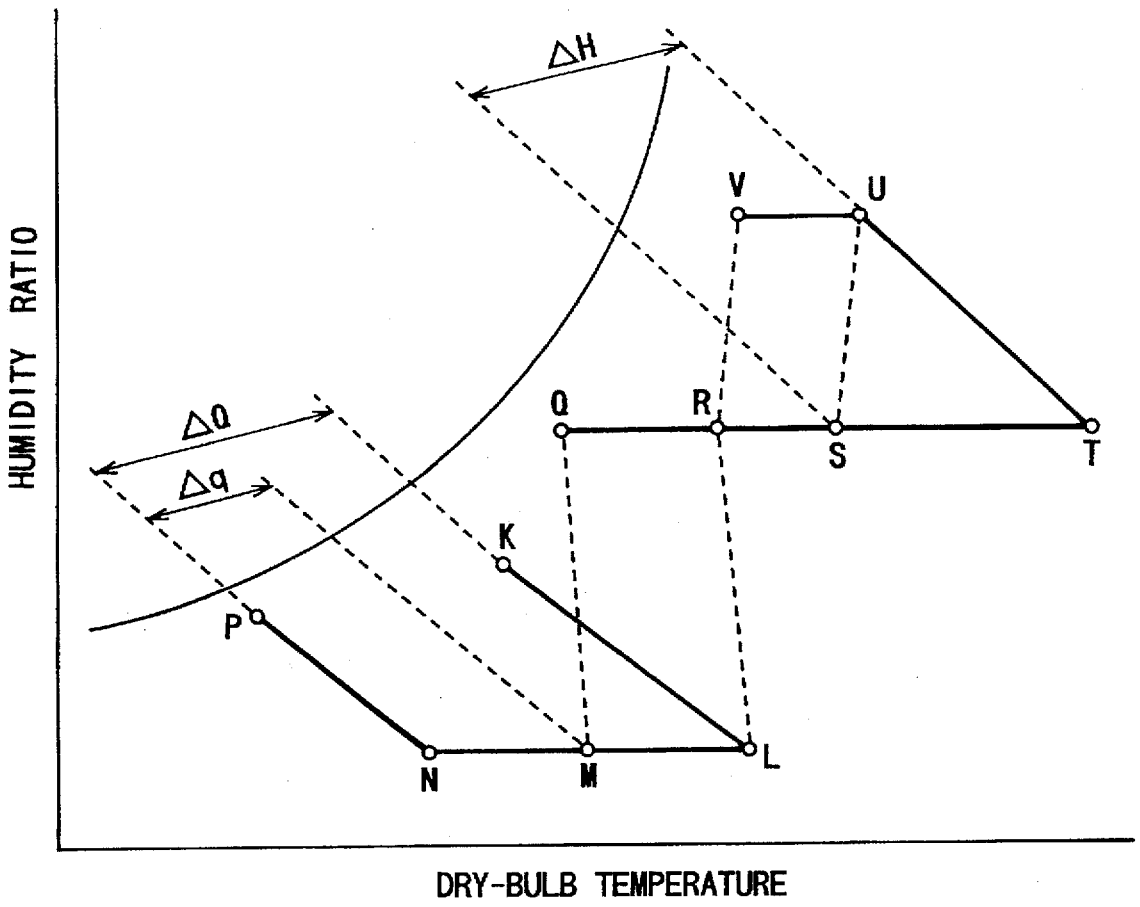
FIG. 3 is a psychrometric chart of the process air circulation in the first embodiment.

The operation of the air conditioner is as follows. FIG. 3 is a psychrometric chart of the air during the air conditioning in the first embodiment. Referring to FIG. 2, the ambient air (process air) from the conditioning spaces 61A~61E is withdrawn into the blower 102 to be pressurized, and the pressurized air is forwarded to the desiccant wheel 103 through the passage 108, wherein the humidity ratio in the process air is lowered by having the moisture in the ambient air removed in the moisture adsorbent in the desiccant wheel 103. Heat released during the adsorption process raises the temperature of the process air. The process air with lower humidity and higher temperature is forwarded to the sensible heat exchanger 104 through the passage 109 and cooled by heat exchange with the outside air (regeneration air). The cooled process air is delivered through the passage 110 to the chilled water heat exchanger 115 for further cooling. The cooled process air is delivered to the humidifier 105 for cooling isenthalpically by water spraying or evaporative humidification, and the cooled process air is returned to the conditioning spaces 61A~61E through the passage 111.

The desiccant becomes loaded with moisture in the above process, and it is necessary to be regenerated. In this embodiment, this is performed using the outside air as regeneration air as follows. Outside air (OA) is withdrawn into the blower 140 through the passage 124 to be pressurized, and the pressurized outside air is delivered to the sensible heat exchanger 104, wherein the outside air cools the process air, and the outside air, having increased its own temperature, is forwarded to the next sensible heat exchanger 121 through the passage 126 wherein heat exchange takes place with the high temperature post-regeneration regeneration air (spent air) to raise its temperature, and the regeneration air exiting the sensible heat exchanger 121 flows into the hot water heat exchanger 120 through the passage 127. The temperature of the regeneration air is raised to a temperature in a range of 60°~80° C. by the hot water, and its relative humidity decreases.

This process corresponds to the sensible heat change of the regeneration air, and the specific heat of the regeneration air is extremely low compared with that of hot water, resulting in a large variation in the air temperature. Therefore, even if the flow rate of the hot water is decreased to cause a large variation in the temperature of the hot water, heat exchange process can still take place quite efficiently. By making the useable temperature difference of the hot water to be large, the flow rate can be decreased, and therefore the transport load is also lowered.

The regeneration air exiting from the hot water heat exchanger 120 has a lower relative humidity than before, and in the process of flowing through the desiccant wheel 103 removes the moisture therefrom, thus performing regeneration of the desiccant material. Spent regeneration air which has passed through the desiccant wheel 103 flows into the sensible heat exchanger 121 through the passage 129, preheats the pre-regeneration regeneration air and is exhausted through the passage 130 to outside environment.

The above-described process will be further explained with reference to psychrometric chart in FIG. 3. The air to be conditioned within the spaces 61A~61E (process air: state K) is withdrawn into the blower 102 to be pressurized, and the pressurized process air is forwarded to the desiccant wheel 103 through the passage 108. The humidity ratio in the process air is lowered by adsorption of moisture in the process air into the moisture adsorbent in the desiccant wheel 103, and the temperature is raised by the heat of adsorption (state L). The process air, having its humidity lowered and temperature raised, is delivered to the sensible heat exchanger 104 through the passage 109, and undergoes heat exchange with outside air (regeneration air) to lower its temperature (state M). The cooled process air is forwarded to the chilled water heat exchanger 115 through the passage 110 to be further cooled (state N). The cooled process air is delivered to the humidifier 105 through the passage 111 and lowers its temperature isenthalpically by water spraying or evaporative humidification (state P), and is returned to the conditioning spaces 61A~61E through the passage 112. By the process described above, an enthalpy difference $\Delta Q$ between the returned air (state K) and the supply air (state P) is generated to perform cooling of the conditioning spaces 61A~61E.

Regeneration process of the desiccant is as follows. Outside air for regeneration (OA: state Q) is withdrawn into the blower 140 through the passage 124 to be pressurized, and is delivered to the sensible heat exchanger 104 to cool the process air while raising its own temperature (state R), and flows into the next sensible heat exchanger 121 through the passage 126, and, in exchanging heat with the high temperature regenerated air, raises its own temperature (state S). Regeneration air leaving the heat exchanger 121 flows into the hot water heat exchanger 120 through the passage 127 so that the temperature is raised to 60°~80° C., and its relative humidity is decreased (state T). Regeneration air having lower humidity passes through the desiccant wheel 103 to remove the moisture therefrom (state U). The spent air which has passed through the desiccant wheel 103 flows into the sensible heat exchanger 121 through the passage 129, and preheats regeneration air exiting from the sensible heat exchanger 104, and lowers its own temperature (state V). Spent air is exhausted to outside environment through the passage 130.

The process described above, i.e., regeneration of desiccant on one hand and dehumidification and cooling of process air on the other, is repeated to provide air conditioning of the conditioning space. It is a common practice to utilize exhaust air from the conditioning room as regeneration air, and in this invention also, there is no problem in recycling the exhaust room air for regeneration air, and the same result will be obtained. It is also possible to produce process air by mixing return air and outside air.

Figure 4:
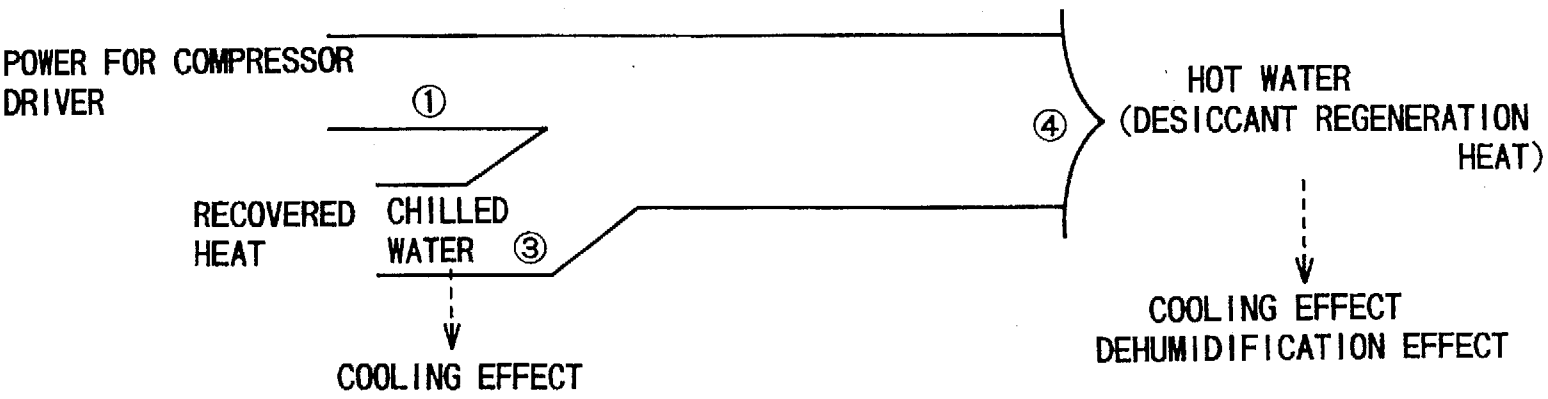
FIG. 4 is an illustration of the flow of heat in the heat pump section of the first embodiment.

FIG. 4 shows the flow of heat in the heat pump section of the desiccant assisted air conditioning system of such a configuration. FIG. 4 shows that the heat input consists of the heat extracted from the chilled water and the power for the compressor driver, and the output heat is totally directed to heating the hot water. In this type of heat pump, temperature lift of the heat pump is produced by the heat extracted from chilled water of 15° C. to raise it to 70° C., making a temperature lift of at least 55° C., and compared with the value of conventional temperature lift of 45° C., it is higher by 22%. Thus the pressure ratio becomes slightly higher, and assuming a value of the power to the compressor driver as 1 thermal unit, the coefficient of performance (COP) can be designed to be about 3. On the other hand, the heat output is 1+3 making a value of 4, and all of this heat is input to heat the hot water circulated in the desiccant assisted air conditioning system.

The value of COP to show the energy efficiency of the desiccant assisted air conditioner as a single machine unit is given by dividing the cooling effect ΔQ shown in FIG. 3 by the regeneration heat, but it is generally reported that this value is at the most about 0.8~1.2. Therefore, if the value of COP for the desiccant assisted air conditioner is assumed to be about 1, it leads to a value of 1 thermal unit for cooling effect by the desiccant assisted air conditioner. Thus, if the input power for the compressor driver in the heat pump is assumed to be 1 thermal unit, then the drive heat input is 4 thermal units for the desiccant assisted air conditioner. It means that hot water contributes cooling effect of 4 thermal units. In the present system, other cooling effects add up to 3 thermal units, thus making a total value of 7 thermal units for the cooling effect. The value of COP for the present system is given by:

$$COP = \text{Cooling effect/compressor input} = 7$$

which is considerably higher than the conventional COP values of less than 4.

As explained above, the present air conditioning system is provided with heat pump devices as well as sensible heat exchangers so as to enable total utilization of heat recovered from cooling cycles to be used as a source of supplying heat for desiccant regeneration. The energy efficiency of the present system is thus significantly increased to provide high cooling performance for the overall system. The recovered heat is used totally for desiccant conditioning purpose, and therefore, the necessity for providing a cooling tower has been eliminated.

It should be noted that in the present embodiment, vapor compression heat pump was used as a heat source as an example, but it is obvious that other types of heat pump such as absorption heat pump can be used equally effectively so long as the heat source provides a heat pumping action.

According to the first embodiment, the air conditioning system includes heat pumps and sensible heat exchangers, and the recovered heat from the cooling medium passage is given further heated to be used as a heat source for desiccant regeneration. The cooling efficiency is improved and a high level of energy conservation is achieved. The elimination of cooling tower, not only contributes to a reduction in the operating energy of the system by avoiding to discard waste heat, but also enables reduction of capital cost for the facility as well as operating cost of the system because of the reduction in water charges, thus resulting in a highly economical operating system. Additionally, since the cooling tower usually located on the rooftop has been eliminated, and there is no need for providing the double-bundle type of heat pumps, the overall system can be made quite compact and the external appearance of the air conditioning system becomes superior to the existing systems.

A second embodiment of the air conditioning system will be explained with reference to FIG. 5. The point of difference in the second embodiment system from the first embodiment is that a manifold duct 82 is provided so that the heat of the air exiting the desiccant conditioner is utilized by leading the exhaust air from each of the desiccant assisted air conditioners 70A~70E to an exhaust heat exchanger 80. The exhaust air route from the exhaust heat exchanger 80 is communicated with the exhaust fan 81 and the exhaust duct 83 for withdrawing the exhaust air EX, and the chilled water route for the exhaust heat exchanger 80 is communicated with the chilled water passages 92, 93 for the chilled water to exchange heat with the exhaust air. The chilled water passages 92, 93 are connected with the chilled water passages 20, 21 at the exit of the heat pump through adjusting valves 90, and a valve 91. This arrangement permits the exhaust heat exchanger 80 to operatively transfer heat from the exhaust air to the chilled water by opening/closing the adjusting valve 90. The configuration of the desiccant assisted air conditioners 70A~70E is basically the same as that shown in FIG. 2, and the explanations are omitted.

The operation of the second embodiment system will be explained.

Figure 5:
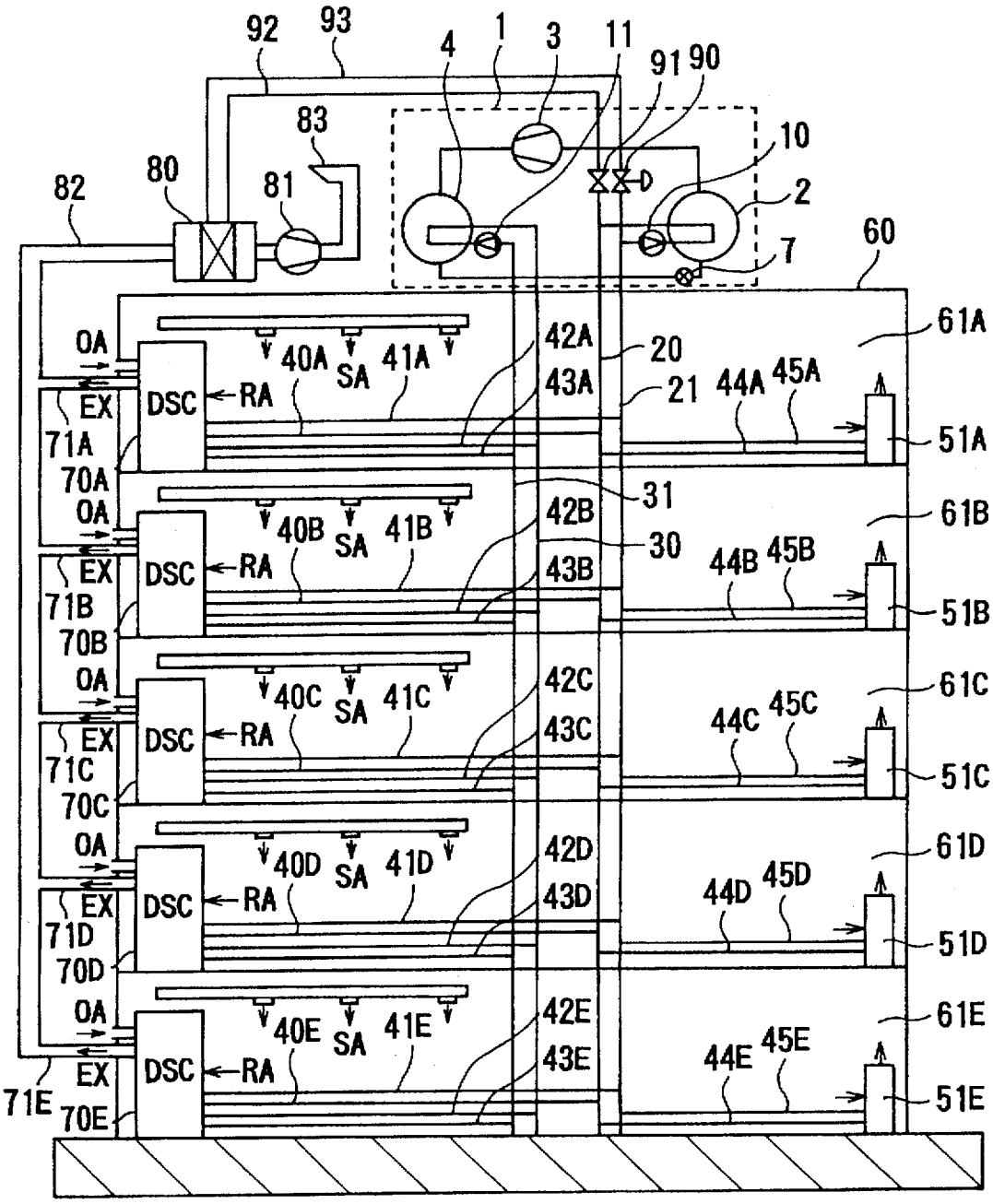
FIG. 5 is a schematic representation of the basic configuration of a second embodiment of the present air conditioning system.

First, during the normal mode operation of the system, in which the latent heat load and the sensible heat load are present in a mixed manner, the valves 90, 91 in FIG. 5 are closed to stop the exhaust heat exchanger 80 taking part in the operation of the system. The method of operation is the same as that for the system shown in FIG. 1, and the explanations will be omitted.

Figure 6:
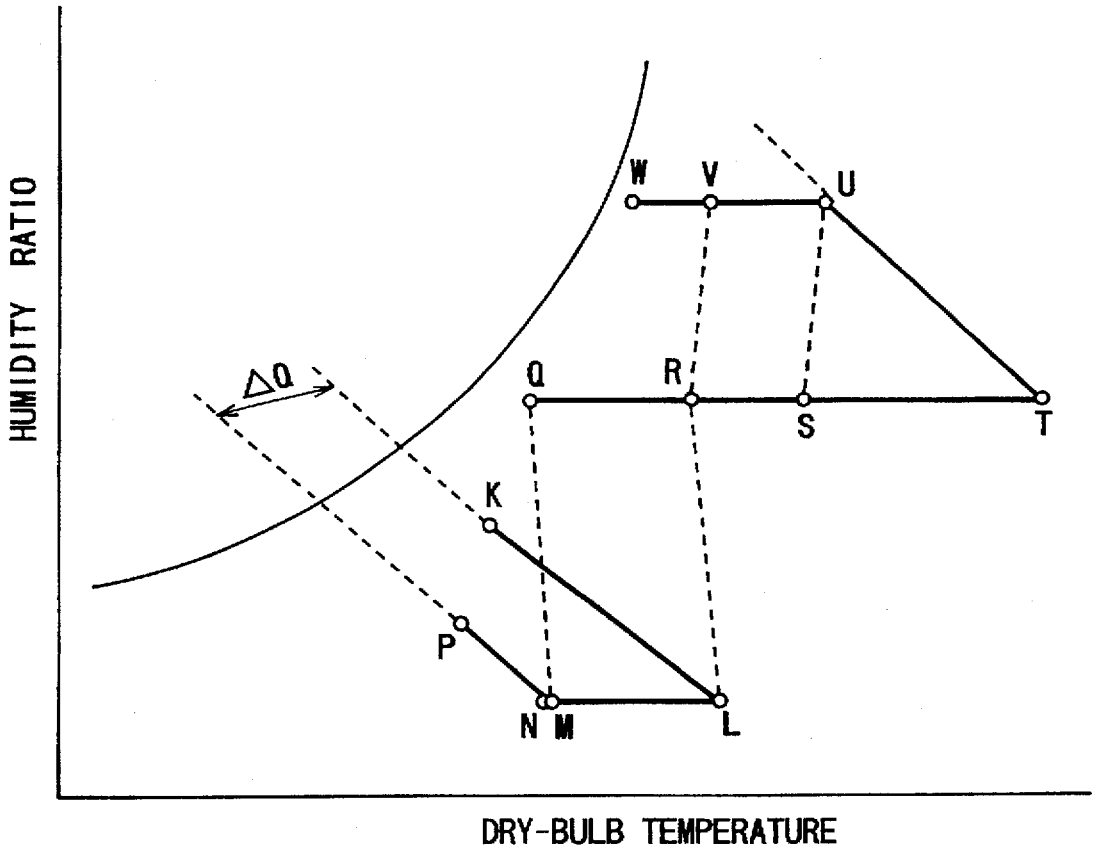
FIG. 6 is a psychrometric chart of the air circulation for desiccant assisted air conditioning regeneration in the second embodiment.

The following explanation pertains to the case of a system operation when the exhaust heat exchanger is activated by opening the valves 90, 91 in FIG. 5. This type of operation is concerned only with dehumidification for comfort control, and is used when there is no need for processing the sensible heat load, for example during "Bai-u", the rainy and humid season in Japan, and only the latent heat load needs to be processed. FIG. 6 is a psychrometric chart for a case of dehumidification air conditioning operation.

The ambient air (process air: state K) in the conditioning spaces 61A~61E is forwarded to the desiccant wheel 103 through the same passages as that shown in FIG. 3 to be adsorbed and removed of its moisture (state L), then to the sensible heat exchanger 104 through the passage 109, and is forwarded to the chilled water heat exchanger 115, after being cooled (state M) by heat exchange with outside air (regeneration air) through the passage 110. However, because the process air has little sensible heat load, it is scarcely cooled and passes through the chilled water heat exchanger 115 without temperature change (state N). Further, the process air is forwarded to the humidifier 105 through the passage 111, and is cooled isentropically (state P), by water spraying or evaporative humidification, and is returned to the conditioning spaces 61A~61E through the passage 112. In this process, an enthalpy difference ΔQ having a large latent heat ratio is generated between the return air (state K) and the supply air (state P) that is used to dehumidify and cool the conditioning spaces 61A~61E.

Desiccant regeneration is carried out as follows. As in the case shown in FIG. 2, outside air (OA: state Q) is exited from the sensible heat exchanger 104 (state R) and is passed through the next sensible heat exchanger 121 (state S), the hot water heat exchanger 120 (state T), the desiccant wheel 103 (state U), the sensible heat exchanger 121 (state V), and is exhausted through the passage 130 to the exhaust ducts 71A~71E. The exhausted air through the exhaust ducts 71A~71E is delivered by the exhaust fan 81 into the exhaust heat exchanger 80 through the exhaust manifold duct 82. The sensible heat of the exhaust air is lost through heat exchange with the chilled water in the exhaust heat exchanger 80, and the temperature of the regeneration air drops (state W).

The operation of the air conditioner section of the system will now be explained. As in the case shown in FIG. 3, ambient air (process air) in the conditioning spaces 61A~61E is withdrawn into the blower 102 and its pressure is raised, and is passed through the desiccant wheel 103 to have its humidity ratio lowered and its temperature raised. Then it is forwarded to the sensible heat exchanger 104 and is cooled by heat exchange with outside air (regeneration air). The cooled process air is forwarded to the chilled water heat exchanger 115 through the passage 110, however, because of its low sensible heat load, the control valve (not shown) in the chilled water passage does not operate and heat transfer does not take place. Cooled ambient air is delivered to the humidifier 105 and drops its temperature through an isentropic process by water spraying or evaporative humidification and is returned through the passage 112 to the conditioning spaces 61A~61E.

Desiccant regeneration is carried out as follows. Outside air (OA) is forwarded to the sensible heat exchanger 104, and cools the process air while its own temperature is raised, and in the next sensible heat exchanger 121, it exchanges heat with the high temperature spent air to further raise its temperature. Regeneration air then flows into the hot water heat exchanger 120, and its temperature is raised by the hot water to 60°~80° C., and its relative humidity is lowered. Regeneration air now flows through the desiccant wheel 103 to regenerate the desiccant material in the desiccant wheel 103, and preheats the incoming regeneration air, then is forwarded to the exhaust ducts 71A~71E through the passage 130. Regeneration air flows through the duct 82 into the exhaust heat exchanger 80, and after being cooled by heat exchange with chilled water, it is withdrawn by the exhaust fan 81, and is then exhausted through the exhaust duct 83 to outside environment. As explained in this example, when the operational mode is dehumidification where the latent heat load is high and the sensible heat load is low, the desiccant assisted air conditioner can be operated without using the chilled water heat exchanger 115.

Figure 7:
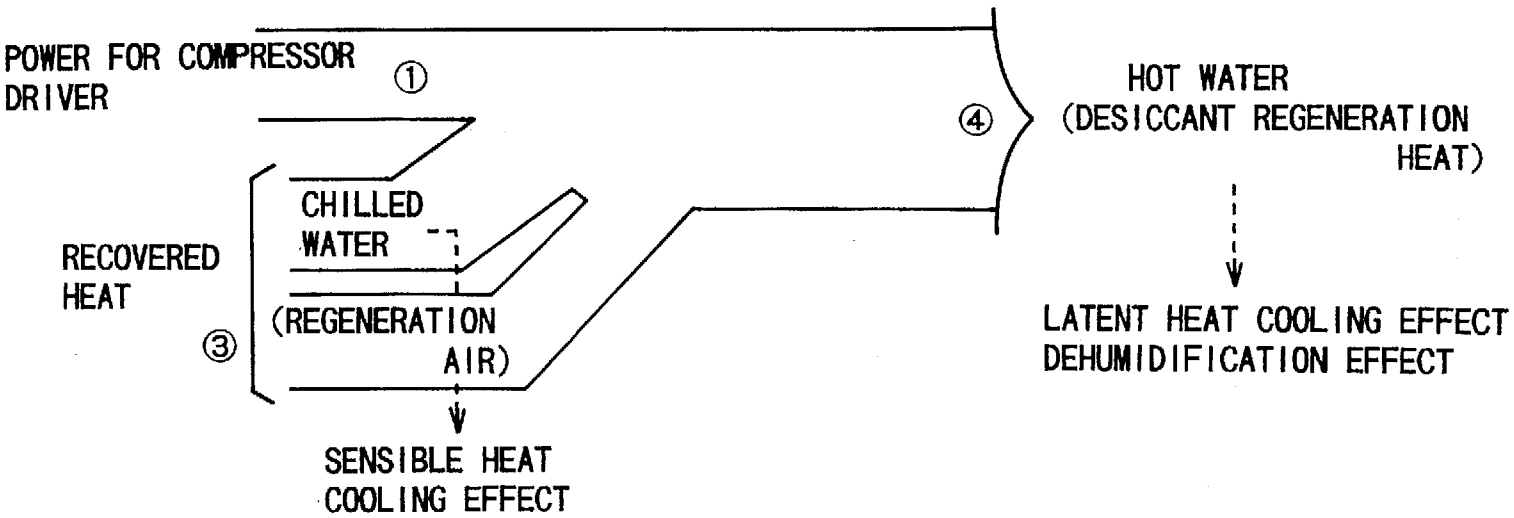
FIG. 7 is an illustration of the flow of heat in the heat pump section of the second embodiment.

FIG. 7 shows the flow of heat in the heat pump section of the system in the dehumidification mode described above. In FIG. 7, heat input consists of the heat recovered from the exhaust heat exchanger 80, heat extracted from the chilled water and the input power to the compressor driver. The output heat is totally directed to heating the hot water. When the sensible heat load is small and the latent heat load is high, the amount of heat available from the air conditioning process is small, however, operation of the heat pump requires some heat input, and as shown in FIG. 7, this heat can be provided by the exhaust heat exchanger 80 in the present system. Accordingly, the air conditioning system of the present invention offers normal mode of air conditioning operation in which there is mixed latent heat load and sensible heat load, but it can also offer dehumidification mode of operation in which most of the heat load is latent heat and sensible heat load is negligible, a condition which might be encountered during the rainy season.

Figure 8:
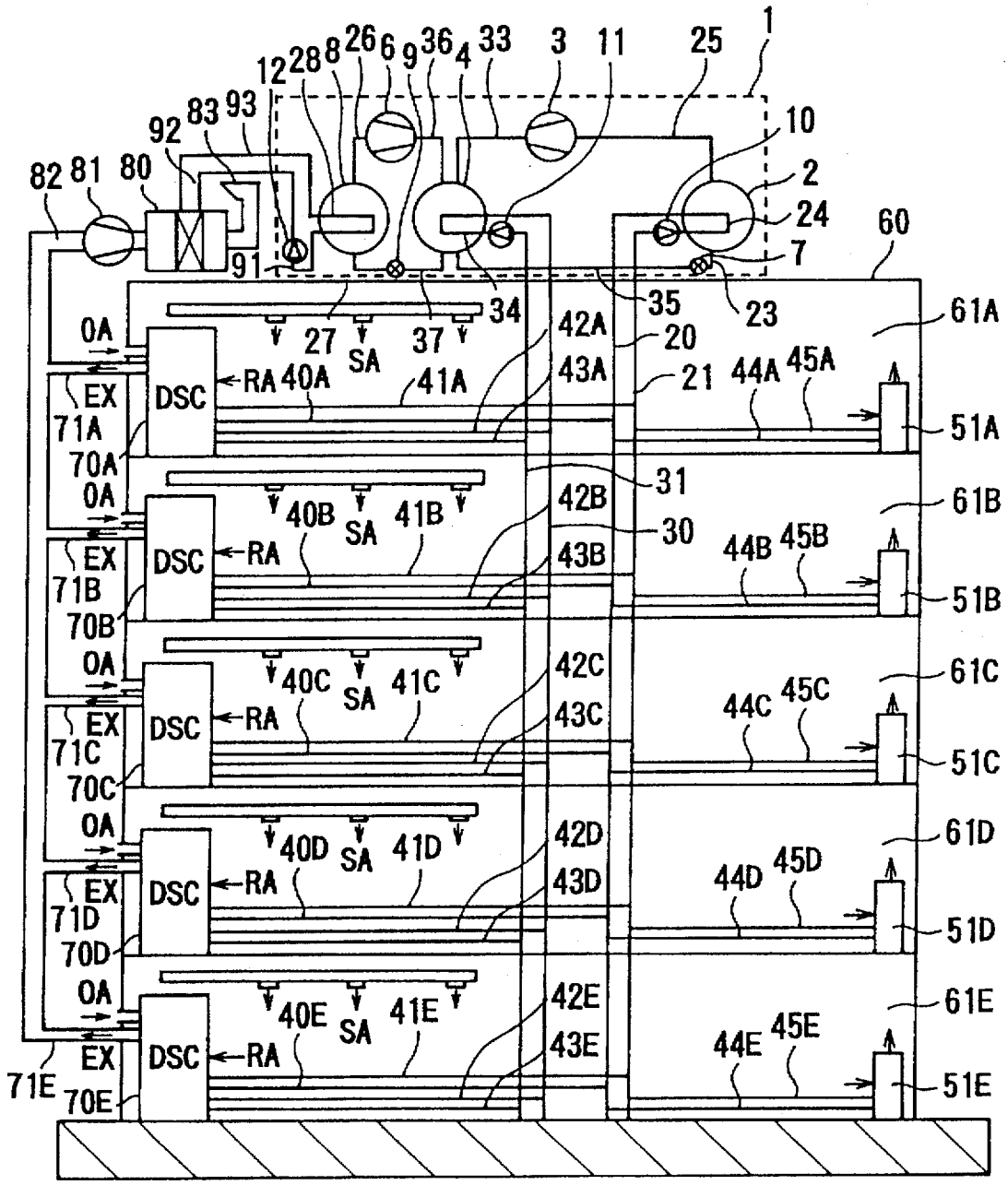
FIG. 8 is a schematic representation of the basic configuration of a third embodiment of the present air conditioning system.

In the following, a third embodiment will be explained with reference to FIGS. 8 to 9. In FIG. 8, the reference numeral 1 refers to a heat pump bounded by the dotted line; and within the heat pump 1, there are a first evaporator 2, a first compressor 3, a condenser 4 (hot water condenser), and an expansion valve 7, which are connected through the passages 25, 33, 35 and 23 to form a first circulation unit. Also within the heat pump 1, there are a second evaporator 8, a second compressor 6, and an expansion valve 9, and these components together with the passages 26, 36, 37 and 27 constitute the second circulation unit.

This configuration enables the heat from the chilled water to be recovered through the heat transfer tube 24 by the heat pump action in the first circulation unit, thereby providing heat to the hot water circulated in the heat transfer tube 34 of the condenser 4. The result obtained in the first circulation unit is not different than the known technologies of this type. In the hot and chilled water passages, a hot water pump 11 and a cooling water pump 10 are provided respectively. Chilled water is produced in the first circulation unit in the heat pump 1, and the hot water is produced in the first and second cycles, and chilled or hot water is circulated through the corresponding chilled water passages (cooling medium passages) 20, 21 or the hot water passages (heating medium passages) 30, 31 provided in the building 60.

Referring to FIG. 8, the reference numeral 12 refers to a heating medium pump which constructs a heat exchange relationship between the second evaporator 8 and the exhaust heat exchanger 80 by circulating a heat transfer medium such as water through the second evaporator 8 and the exhaust heat exchanger 80 through the passages 91, 92 and 93, so that the heat recovered from the exhaust heat exchanger 80 can be forwarded to and recovered in the second evaporator 8.

In this embodiment also, there are provisions similar to those shown in FIG. 5 such as fan coil units 51A~51E for heat exchange with ambient air which are used to process sensible heat load in the perimeter regions of the building; desiccant assisted air conditioners 70A~70E for air conditioning of the core region of the building; and the exhaust heat exchanger 80 connected to the exhaust manifold duct 82. The configuration of the desiccant assisted air conditioners 70A~70E of the system is the same as that in FIG. 2, and the explanations will be omitted.

The exhaust heat exchanger 80 functions as heat exchanger between the exhaust air EX and the thermal medium circulating in the second evaporator 8, and exhaust heat recovery is carried out through the second evaporator 8 selectively by operating on and off the compressor 6 in the second circulation unit. By this arrangement, an advantage is obtained that the exhaust heat recovered in the second circulation unit from the thermal medium in the second evaporator 8 through the passage 28 provides heat by the heat pump action to heat the hot water circulating in the heat transfer tube 34 of the condenser 4.

The operation of the air conditioning system of the above-described third embodiment will be explained. First, in the first operational mode, normal mode of air conditioning in which latent and sensible heat load are present in a mixed manner, the compressor 6 in the second circulation unit shown in FIG. 8 is stopped. In other words, the operation of the second circulation unit is stopped so that the exhaust heat exchanger 80 does not function and only the first circulation unit operates. In this mode of operation, process is the same with the operation of the system shown in FIGS. 1, or the system of FIG. 5 when the valves 90, 91 are closed and the explanations will not be repeated.

In the second operational mode, dehumidification mode, the sensible heat load is negligible and only the latent heat load is present. In this mode, the second compressor 6 in FIG. 8 is operated to activate the second circulation unit so that the thermal medium is circulated between the second evaporator 8 and the exhaust heat exchanger 80 to operate the exhaust heat exchanger 80. The operation of desiccant assisted air conditioner can be explained in the same way using FIG. 6 for the system shown in FIG. 5, and the explanations will not be repeated.

Figure 9:
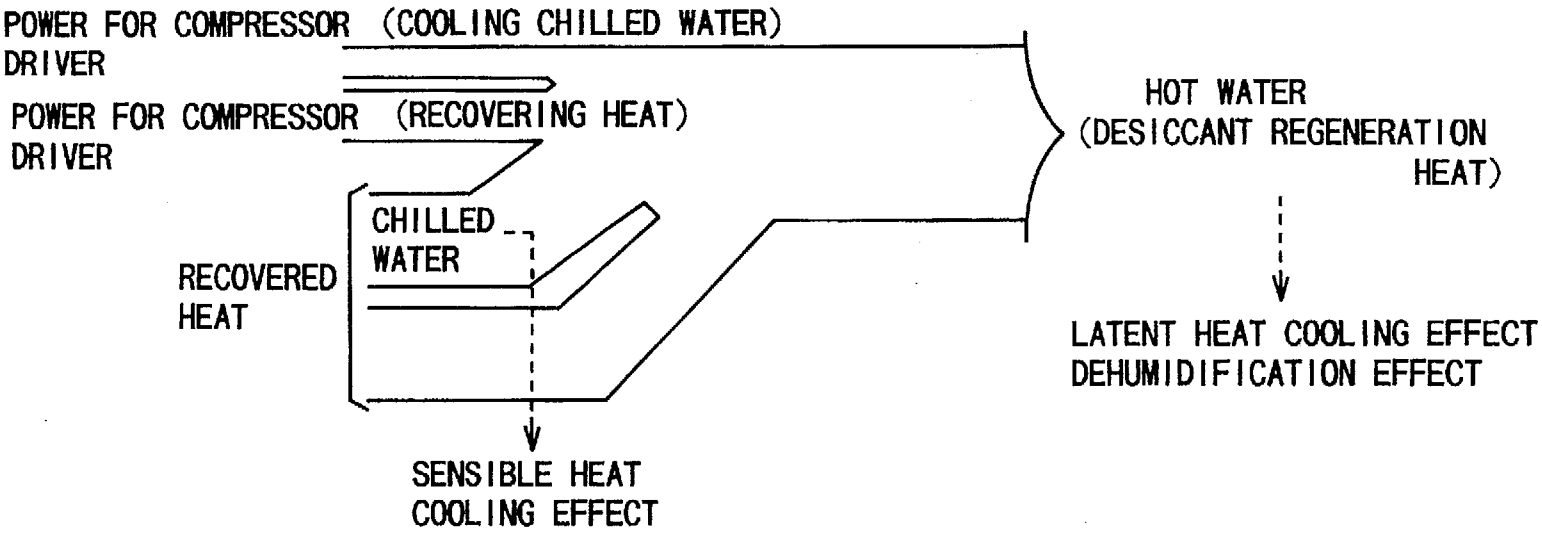
FIG. 9 is an illustration of the flow of heat in the heat pump section of the third embodiment.

FIG. 9 shows the flow of heat in the heat pump section of the system. In FIG. 9, the heat input into the system consists of the heat recovered from the exhaust heat exchanger 80, heat extracted from the chilled water and the input power to the first and second compressors. The output heat is totally directed to heating the hot water. When the sensible heat load is low and the latent heat load is high, the quantity of heat available from the chilled water in the air conditioning section becomes small. However, heat input is required to continue the operation of the heat pump, and in this system shown in FIG. 9, this heat is supplied by the exhaust heat exchanger 80. In the second circulation unit, since the heat transfer operation temperature can be set higher than chilled water temperature, the compression ratio of the compressor can be set lower so that the power for driving compressor can be decreased compared with the second embodiment where a common compressor for both cycles is used.

Figure 10:
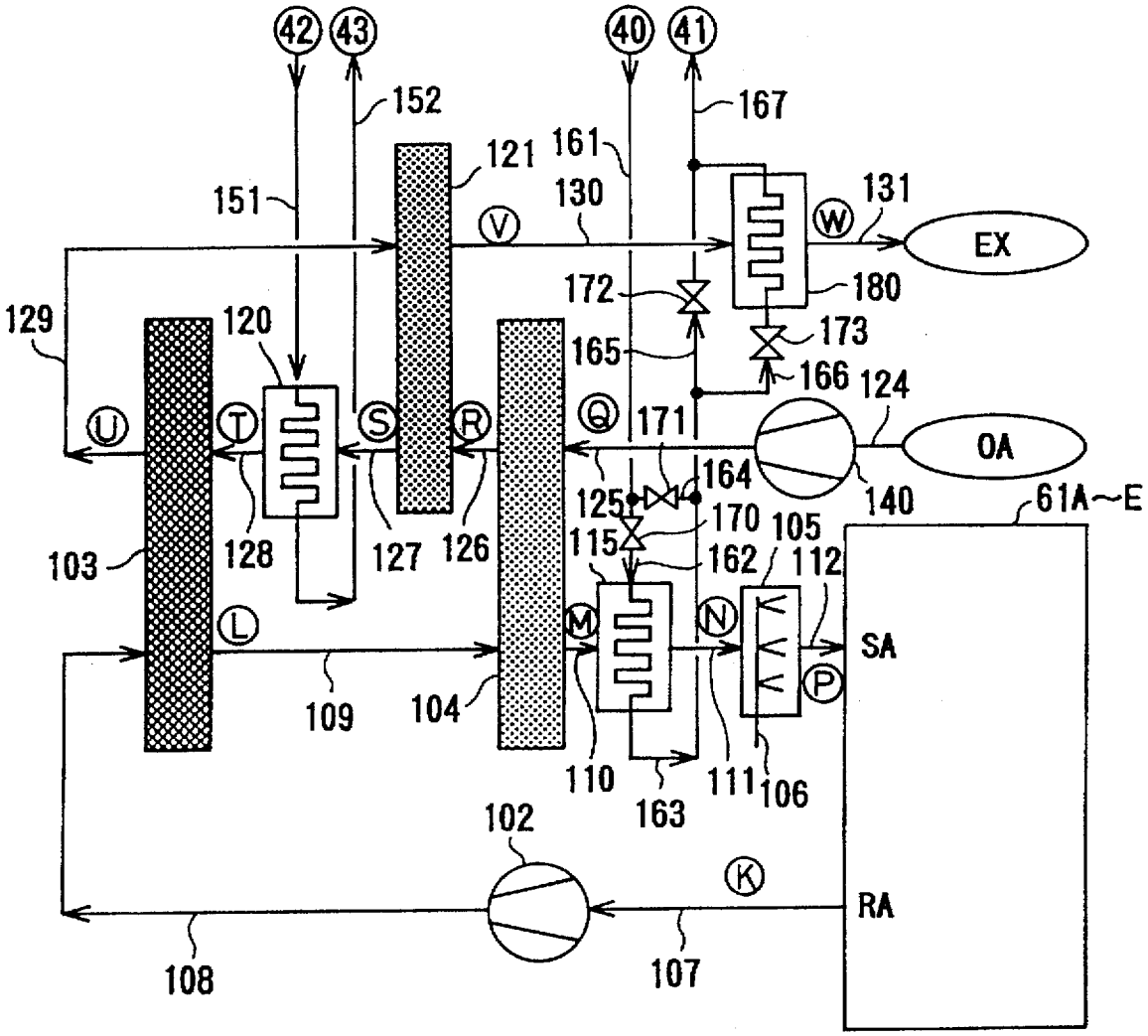
FIG. 10 is a schematic representation of the desiccant assisted air conditioner section in the fourth embodiment.
Figure 11:
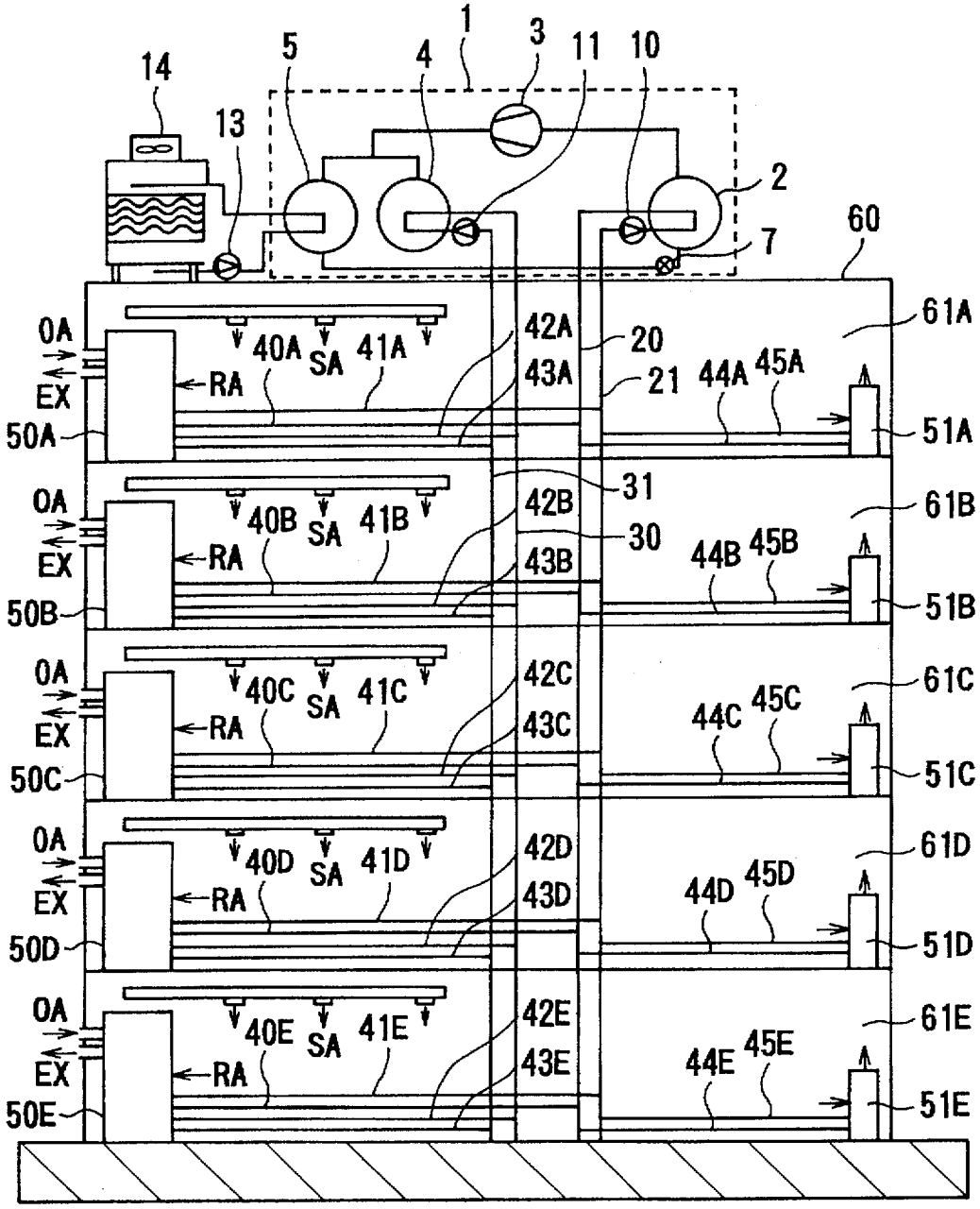
FIG. 11 is a schematic representation of the basic configuration of a conventional air conditioning system.
Figure 12:
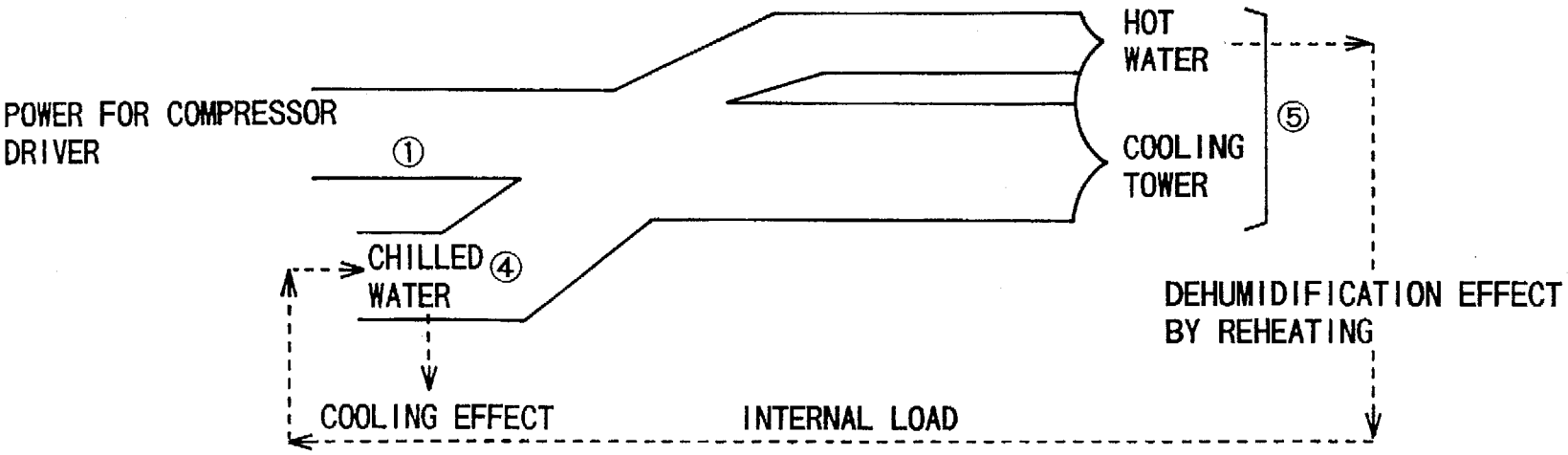
FIG. 12 is an illustration of the flow of heat in the conventional desiccant assisted air conditioning system.

In the following, a fourth embodiment will be presented. The overall configuration of the air conditioning system is the same as that shown in FIG. 1, and the explanations will be omitted. FIG. 10 shows the basic configuration of the desiccant assisted air conditioner section of the system. The process air route in this embodiment is the same as that for the system shown in FIG. 2, but the point of difference is, in the regeneration air route, an exhaust heat exchanger 180 is provided at the high temperature exit side of the sensible heat exchanger 121 for heat exchange with the chilled water (cooling medium) exiting from the chilled water heat exchanger 115.

The thermal medium passage communicating the heat pump 1 of the air conditioning system with the desiccant conditioners is the same as in FIG. 2 for the hot water passage of the system. For the chilled water passage, the components are connected as follows. The chilled water outlet of the chilled water heat exchanger 115 is connected to the exhaust heat exchanger 180 through the passage 163, the chilled water outlet of the exhaust heat exchanger 180 is connected to the chilled water passage 21 through the passages 167 and 41A~41E. In the chilled water passage for the chilled water heat exchanger 115, there is provided a bypass path 164, and the inlet to the chilled water heat exchanger 115 is provided with a valve 170, and the bypass path 164 is provided with a valve 171. In the chilled water passage for the exhaust heat exchanger 180, there is provided a bypass path 165, and the inlet to the exhaust heat exchanger 180 is provided with a valve 173, and the bypass path 165 is provided with a valve 172. This configuration of the chilled water passage enables selective operation of either the chilled water heat exchanger 115 or the exhaust heat exchanger 180 by selectively opening/closing the valves 170, 171, 172 and 173.

Next, in the normal mode of air conditioning, in which latent and sensible heat loads are present in a mixed manner, the valves 171, 173 are closed while the valves 170, 172 are opened in FIG. 10 so that the exhaust heat exchanger 180 is stopped. In the dehumidification mode of operation, such as during the rainy season in which there is negligible sensible heat load and only the latent heat load is present, the valves 171,173 in are opened while the valves 170,172 are closed FIG. 10 to operate the exhaust heat exchanger 180. In either case, the operation of the desiccant conditioning can be explained using either FIG. 1, 6 or 7, and the previous explanations apply equally in this case, and will not be repeated.

What is claimed is:

1. An air conditioning system comprising:

a heat pump;

a heating medium passage for circulating a heating medium for extracting a heating capacity from said heat pump;

a cooling medium passage for circulating a cooling medium for extracting a cooling capacity from said heat pump;

a first air conditioning device including a first heat exchanger for obtaining ambient control of conditioning spaces by heat exchange between said cooling medium in said cooling medium passage and air within a conditioning space;

a second air conditioning device including a process air passage, a regeneration air passage and a desiccant device communicatable alternatingly with either said process air passage or said regeneration air passage for dehumidification of process air and regeneration of said desiccant device by regeneration air; and a regeneration heat exchange device for heating said regeneration air, by heat exchange between said regeneration air circulating in said regeneration air passage and said heating medium circulating in said heating medium passage.

2. An air conditioning system as claimed in claim 1, further comprising a cooling heat exchanger for cooling said process air by heat exchange between said cooling medium circulating in said cooling medium passage and post-desiccant process air which has been flowed through said desiccant device.

3. An air conditioning system as claimed in claim 1, wherein said heat pump is in connection with a plurality of said first air conditioning devices and a plurality of said second air conditioning devices.

4. An air conditioning system as claimed in claim 2, wherein said heat pump is provided with a plurality of said first air conditioning devices and a plurality of said second air conditioning devices.

5. An air conditioning system as claimed in claim 1, further comprising an exhaust heat exchanger for heat exchange between spent regeneration air discharged from said second air conditioning device and said cooling medium circulating in said cooling medium passage.

6. An air conditioning system as claimed in claim 2, further comprising an exhaust heat exchanger for heat exchange between spent regeneration air discharged from said second air conditioning device and said cooling medium circulating in said cooling medium passage, said cooling medium passage from said exhaust heat exchanger being selectively communicated with said cooling heat exchanger or said first heat exchanger by way of valve means.

7. An air conditioning system as claimed in claim 6, wherein said valve means is provided with an opening adjusting device for controlling an opening of said valve means in accordance with thermal load for cooling said process air.

8. An air conditioning system as claimed in claim 1, further comprising a second heat pump sharing a condenser with said heat pump; and an exhaust heat exchanger for heat exchange between an evaporator disposed in said second heat pump and regeneration air discharged from said second air conditioning device for recovering heat therefrom and providing heat to said heating medium.

9. An air conditioning system as claimed in claim 2, wherein said regeneration air passage is provided with an exhaust heat exchanger for heat exchange between said cooling medium and post-desiccant regeneration air which has been flowed through said desiccant device, and said cooling medium passage is selectively communicated to said exhaust heat exchanger and said cooling heat exchanger.

10. An air conditioning system as claimed in claim 1, wherein said heat pump is a vapor compression heat pump.

11. An air conditioning system as claimed in claim 1, wherein said heat pump is an absorption heat pump.

* * * * *

UNITED STATES PATENT AND TRADEMARK OFFICE

CERTIFICATE OF CORRECTION

PATENT NO.: 5,718,122
DATED : Feb. 17, 1998
INVENTOR(S): Kensaku MAEDA

It is certified that error appears in the above-identified patent and that said Letters Patent is hereby corrected as shown below:

Column 8, line 37, change "isentropically" to --isenthalpically--.

Column 9, line 5, change "isentropic" to --isenthalpic--.

Signed and Sealed this

Twenty-eighth Day of July, 1998

*Attest:*

*Attesting Officer*

BRUCE LEHMAN

*Commissioner of Patents and Trademarks*